US008421569B1

(12) United States Patent
He

(10) Patent No.: US 8,421,569 B1
(45) Date of Patent: Apr. 16, 2013

(54) MAGNETIC FIELD GENERATOR FOR MEASURING IMMUNITY OF ELETRONIC DEVICES TO ELECTROMAGNETIC FIELDS

(75) Inventor: Xiao-Lian He, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/337,130

(22) Filed: Dec. 25, 2011

(30) Foreign Application Priority Data

Dec. 2, 2011 (CN) ..... 2011 1 0395160

(51) Int. Cl.
*H01F 7/20* (2006.01)
*H01F 13/00* (2006.01)

(52) U.S. Cl.
USPC ..... 335/284

(58) Field of Classification Search ..... 335/215, 335/284–295; 324/326
See application file for complete search history.

(56) References Cited

U.S. PATENT DOCUMENTS 4,797,618 A * 1/1989 De Vries ..... 324/326
7,940,049 B2 * 5/2011 Loubet ..... 324/326

* cited by examiner

*Primary Examiner* — Bernard Rojas
(74) *Attorney, Agent, or Firm* — Altis Law Group, Inc.

(57) ABSTRACT

A magnetic field generator includes a holding unit, an induction winding, and an operation unit. The induction winding is slidably and rotatably mounted on the holding unit. The operation unit is electrically connected to the induction winding, and positioned in a predetermined distance away from the induction winding. The operation unit provides current to the induction winding, and the induction winding generates magnetic field in response to receiving the current from the operation unit.

7 Claims, 5 Drawing Sheets

MAGNETIC FIELD GENERATOR FOR MEASURING IMMUNITY OF ELETRONIC DEVICES TO ELECTROMAGNETIC FIELDS

BACKGROUND

1. Technical Field

The present disclosure relates to measuring immunity of electronic devices to electromagnetic fields, and particularly to a magnetic field generator for measuring immunity of electronic devices to electromagnetic fields.

2. Description of Related Art

Induction windings are often used as magnetic field generators in measuring immunity of electronic devices to electromagnetic fields. For example, when the immunity of electromagnetic field of an electronic device needs to be measured, the electronic device can be received in or positioned adjacent to an induction winding, and the induction winding is electrically connected to a current source. When current provided by the current source flows through the induction winding, magnetic field is generated around the induction winding. The strength of the magnetic field is measured using a common magnetic field strength measuring device, such as a Gauss meter. Thus, the immunity of electromagnetic field of the electronic device can be measured in the magnetic field with the determined strength. Furthermore, the strength of the magnetic field can be adjusted by adjusting strength of the current provided by the current source, and thus the immunity of the electromagnetic field of the electronic device can be respectively measured in the magnetic field with different strengths.

However, when the strength of the magnetic field generated by the induction winding is measured, an operator may need to work in the magnetic field over the course of time to operate the induction winding, the magnetic field strength measuring device, and the measured electronic device. Thus, health of the operator may be adversely affected by the magnetic field.

Therefore, there is room for improvement within the art.

BRIEF DESCRIPTION OF THE DRAWINGS

Many aspects of the present disclosure can be better understood with reference to the following drawings. The components in the various drawings are not necessarily drawn to scale, the emphasis instead being placed upon clearly illustrating the principles of the present disclosure. Moreover, in the drawings, like reference numerals designate corresponding parts throughout the figures.

DETAILED DESCRIPTION

Figure 1:
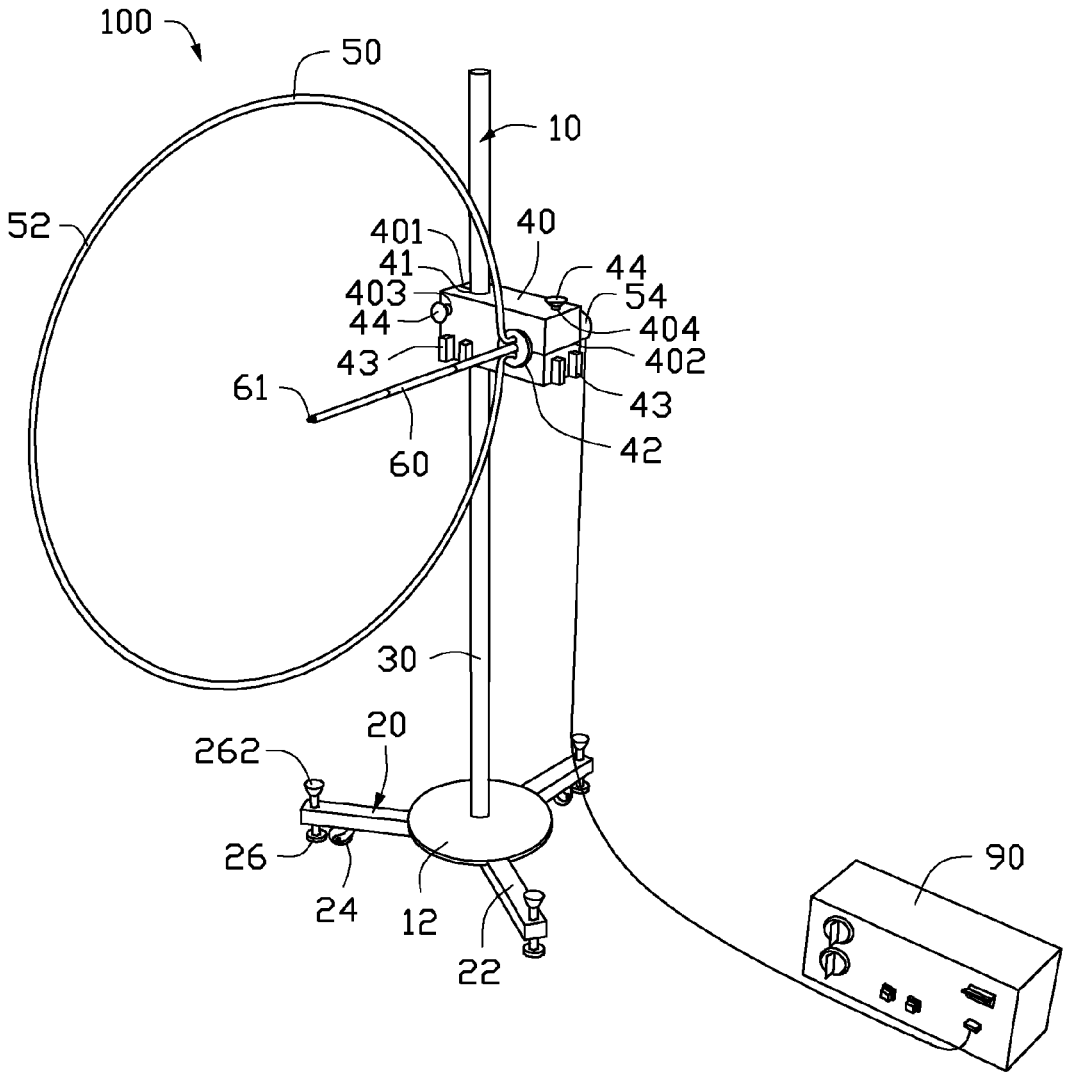
FIG. 1 is a schematic view of a magnetic field generator, according to an exemplary embodiment.
Figure 2:
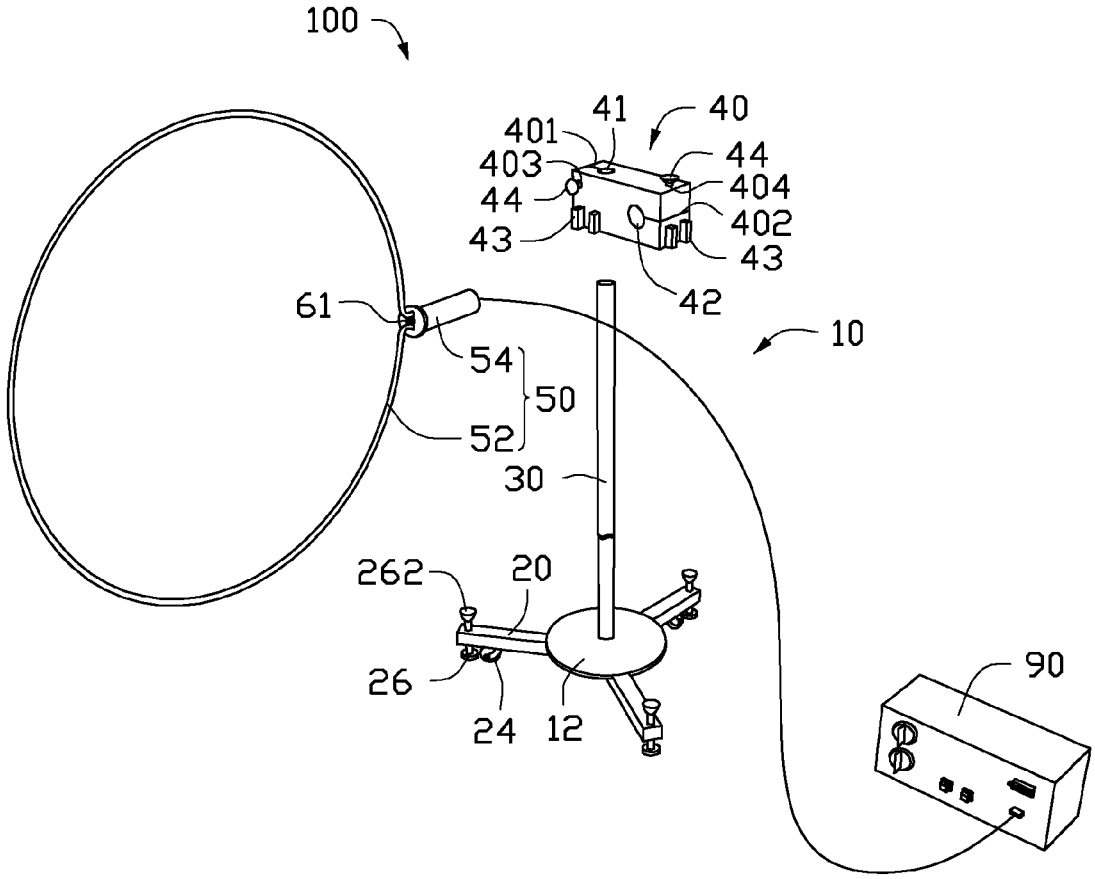
FIG. 2 is an exploded view of the magnetic field generator shown in FIG. 1.

FIG. 1 and FIG. 2 show a magnetic field generator 100, according to an exemplary embodiment. The magnetic field generator 100 can be used to generate magnetic fields for measuring immunity of various electronic devices, such as common portable electronic devices and house appliances, to electromagnetic fields. The magnetic field generator 100 includes a holding unit 10, an induction winding 50, and an operation unit 90. The induction winding 50 is mounted on the holding unit 10 and is electrically connected to the operation unit 90.

The holding unit 10 includes a base 12, a holder 20, an adjusting pole 30, and a support block 40. The base 12 is substantially a round planar board. The holder 20 is substantially a star-shaped frame mounted under the base 12. In this embodiment, the holder 20 includes three beams 22 converged together, three conveying wheels 24, and three support feet 26. The conveying wheels 24 and the support feet 26 are all mounted on the beams 22. Each of the beams 22 has one conveying wheel 24 and one support foot 26 correspondingly mounted thereon. The support feet 26 are substantially bolts and are rotatably mounted on distal ends of the beams 22 by threads (not shown), respectively. The support feet 26 can be used to stably position the holder 20 on predetermined positions. Furthermore, each support foot 26 includes a rotation head 262 extending from an upside of a corresponding beam 22 to facilitate rotations of the support foot 26. Due to the threads of the support feet 26, the rotations of the support feet 26 can adjust the lengths of the support feet 26 extending from the undersides of the beams 22, thereby adjusting the heights of the holder 20 and the base 10. Each of the conveying wheels 24 is mounted underside a corresponding beam 22 and positioned adjacent to a corresponding support foot 26 mounted on the beam 22. The holder 20 and the base 10 can be horizontally moved due to rotation of the conveying wheels 24.

The adjusting pole 30 is perpendicularly mounted on a center of the base 10. The support block 40 is substantially a cuboid-shaped block, and defines a first through hole 41 and a second through hole 42. An axis of the first through hole 41 is perpendicularly to an axis of the second through hole 42. The adjusting pole 30 is inserted in the first through hole 41 to mount the support block 40 on the adjusting pole 30. The second through hole 42 can be used to mount the induction winding 50 on the support block 40.

The support block 40 further defines a first aperture 401, a second aperture 402, a first fastening hole 403, and a fourth fastening hole 404. The first aperture 401 opens at a side surface of the support block 40 and communicates with the first through hole 41. The second aperture 402 opens at an opposite side surface of the support block 40 and communicates with the second through hole 42. The first and second fastening holes 403, 404 are both screw holes. The first fastening hole 403 opens at a side surface of the support block 40 and communicates with the first aperture 401, and an axis of the first fastening hole 403 is perpendicular to the axis of the first through hole 41. The second fastening hole 404 opens at another side surface of the support block 40 and communicates with the second aperture 402, and an axis of the second fastening hole 403 is perpendicular to the axis of the second through hole 42.

The support block 40 further includes a plurality of retaining protrusions 43 and two fasteners 44. The retaining protrusions 43 are configured for mounting magnetic field strength measuring devices (not shown), such as Gauss meters, on the support block 40. The two fasteners 44 are both bolts, and can be respectively screwed in the first and second fastening holes 403, 404 and extended into the first and second apertures 401, 402. Thus, rotations of the fastener 44 screwed in the first fastening hole 403 can drive parts of the support block 40 at two sides of the first aperture 401 to be in tight contact with each other or away from each other, and thereby respectively fasten and release the adjusting pole 30. When the support block 44 releases the adjusting pole 30, the support block 44 can slide along and rotate around the adjusting pole 30. Rotations of the fastener 44 screwed in the second fastening hole 404 can drive parts of the support block 40 at two sides of the second aperture 402 to be in tight contact with each other or away from each other, and thereby respectively fasten and release the induction winding 50. The induction winding 50 can rotate in the second through hole 42 when the support block 44 is released.

The induction winding 50 includes an induction member 52, an insertion member 54, a support pole 60, and a retainer 61. The induction member 52 is substantially an annular winding, and the insertion member 54 is substantially a cylinder made of insulation material. Two ends of the induction winding 50 are both inserted in the insertion member 54. The insertion member 54 is received in the second through hole 42 to mount the induction winding 50 on the support block 40.

The support pole 60 is a telescopic pole coaxially received in the insertion member 54, and can be retracted inside and extended from the insertion member 54. The retainer 61 is mounted on a distal end of the support pole 60. The retainer 61 can be a clamp or other retaining mechanisms configured for retaining probes of the magnetic field strength measuring devices mounted on the retaining protrusions 43. When the support pole 60 is extended from the insertion member 54, the retainer 61 can be moved between the periphery and the center of the induction member 52 along a radius of the induction member 52. By adjusting a length of the support pole 60, the retainer 61 can be placed at any desirable position on the radius of the induction member 52.

The operation unit 90 can provide electric power to the induction winding 50. The operation unit 90 includes a common working power supply (not labeled) and a user interface of the working power supply, such as switch buttons of the working power supply and knobs for adjusting currents output from the working power supply. The operation unit 90 is electrically connected to the two ends of the induction member 52 via a cable, which has one end inserted in the insertion member 54.

In use, one or more magnetic field strength measuring devices (not shown), such as Gauss meters, are mounted on the retaining protrusions 43 and electrically connected to a common display device (not shown) in a predetermined safe distance away from the induction member 52. The support pole 60 is extended to the center of the induction member 52, and probes of the magnetic field strength measuring devices are fixed on the retainer 61. The operation unit 90 is also positioned to be in the safe distance away from the induction member 52, and is operated to turn on the working power supply and provide current to the induction member 52. Thus, magnetic field is generated in the induction member 52, and the magnetic field strength measuring devices measure strength of the magnetic field via their probes and transmit value of the strength of the magnetic field to the display device to display. The strength of the magnetic field can be adjusted to predetermined values by operations on the operation unit 90 for adjusting strength of the current provided by the working power supply of induction winding 50. Because both the display device and the operation unit 90 are in the safe distance away from the induction member 52, operators of the display device and the operation unit 90 can be protected from the magnetic field.

When the strength of the magnetic field is adjusted to the predetermined value, the strength of the current provided by the working power supply of induction winding 50 corresponding to the predetermined strength of the magnetic field is recorded, and the working power supply of the induction winding 50 is turned off. The probes of the magnetic field strength measuring devices are released and are taken out of the induction member 52, and the support hole 60 is retracted inside the insertion member 54. The support block 40 and the induction winding 50 are adjusted to a predetermined height, and thus the magnetic field generator 100 can be used to generate magnetic field in electromagnetic immunity measurements of electronic devices.

Figure 3:
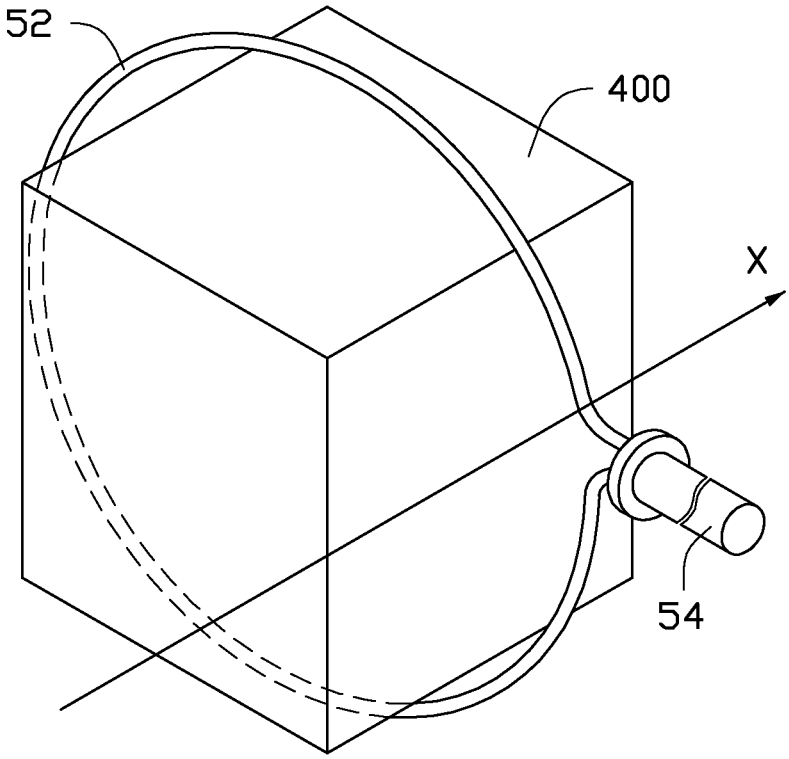
FIG. 3 is a schematic view of a magnetic force generated by a induction winding of the magnetic field generator shown in FIG. 1 passing through a measured electronic device along a first direction.
Figure 4:
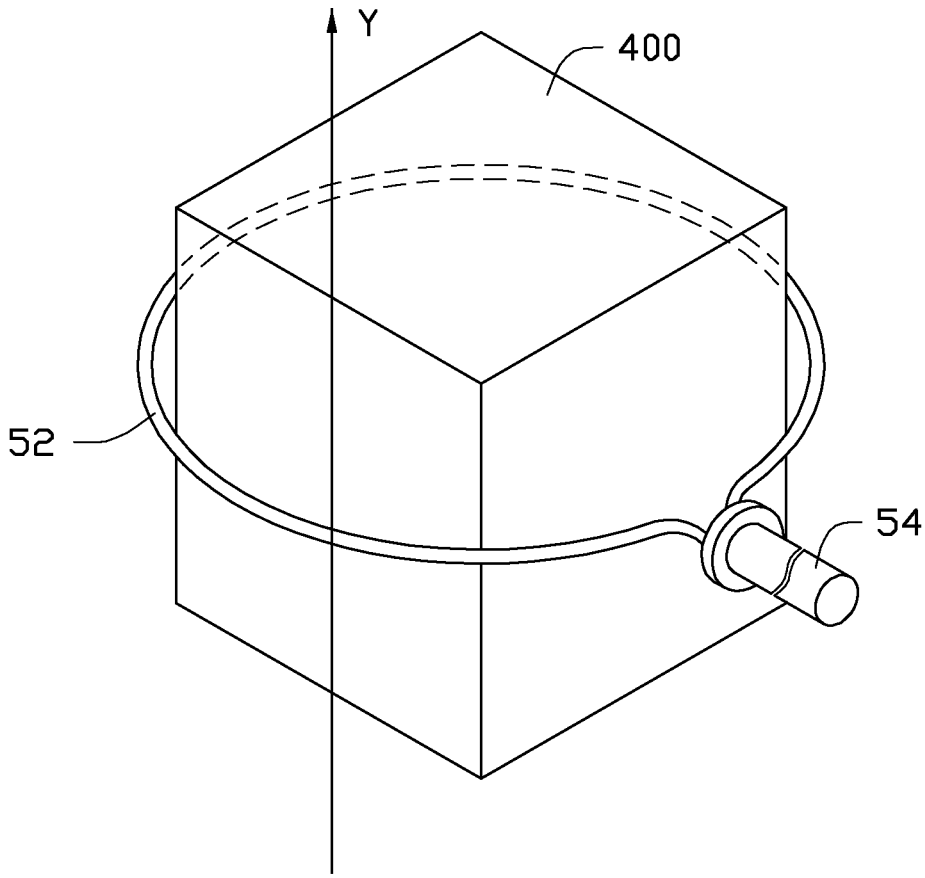
FIG. 4 is a schematic view of a magnetic force generated by the induction winding shown in FIG. 3 passing through the measured electronic device shown in FIG. 3 along a second direction.
Figure 5:
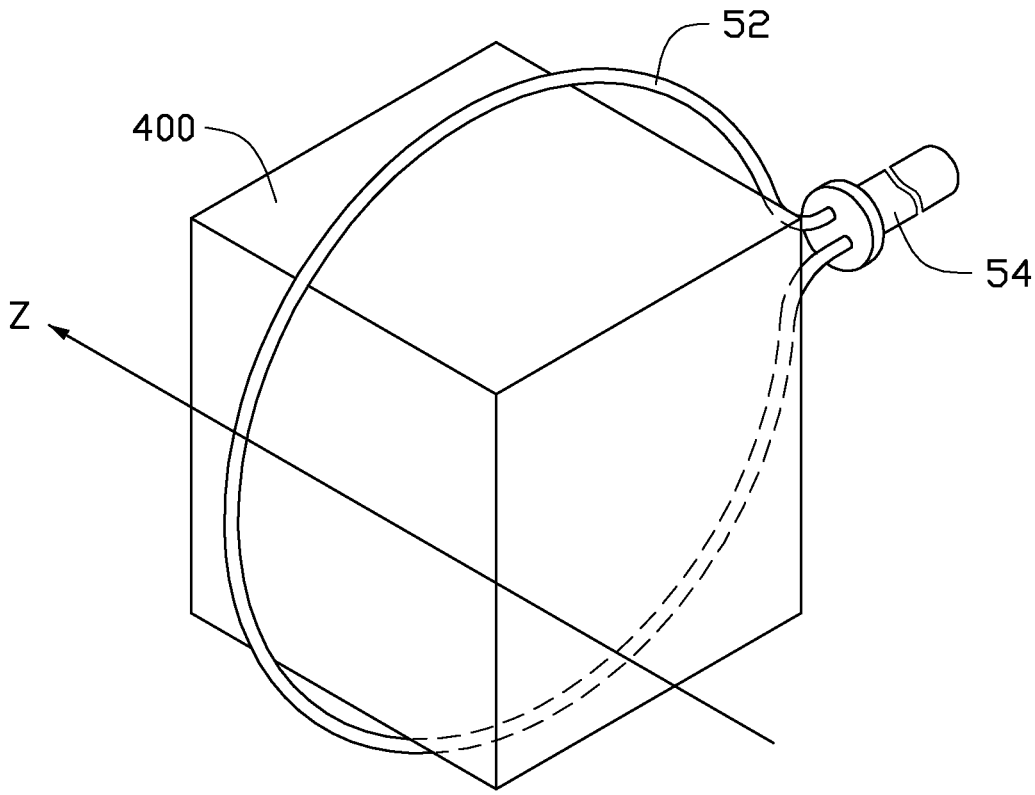
FIG. 5 is a schematic view of a magnetic force generated by the induction winding shown in FIG. 3 passing through the measured electronic device shown in FIG. 3 along a third direction.

Also referring to FIGS. 3-5, an electronic device 400 is inserted in the induction member 52 to be positioned in the magnetic field generated by the induction member 52 with the predetermined strength, and the magnetic field generator 100 is used to generate magnetic field with predetermined strength for an electromagnetic immunity measurement of the electronic device 400. In this embodiment, the electronic device 400 is electrically connected to a common signal processing device, such as an oscilloscope, and the oscilloscope is also positioned in the safe distance away from the induction member 52. Thus, the electronic device 400 is respectively inserted in the induction member 52 in three positions, such that magnetic lines of force of the magnetic field generated by the induction member 52 respectively pass through the electronic device 400 along an X-axis, a Y-axis, and a Z-axis (i.e., three directions that are perpendicular to each other). The working power supply of the induction winding 50 is turned off when the inserting positions of the electronic device 400 is being changed, thereby protecting the operators from the magnetic field.

Because the magnetic lines of force of the magnetic field generated by the induction member 52 respectively pass through the electronic device 400 along the X-axis, the Y-axis, and the Z-axis in the three inserting positions, it is readily appreciated that the magnetic field generated by the induction member 52 respectively has polarities formed along the X-axis, the Y-axis, and the Z-axis relative to the electronic device 400 in the three inserting positions. In each of the three inserting positions, the electronic device 400 is turned on and works in the magnetic field with a polarity corresponding to the inserting position, and the signal processing device processes working signals of the electronic device 400 to determine whether the electronic device 400 works normally in the magnetic field with the polarity corresponding to the inserting position relative to the electronic device 400. In this way, the electromagnetic immunity of the electronic device 400 to magnetic fields with different polarities can be respectively measured. Because the signal processing device is also in the safe distance away from the induction member 52, operators of the signal processing device can be protected from the magnetic field.

The present magnetic field generator 100 can generate magnetic field with predetermined strengths and polarities in electromagnetic immunity measurements of electronic devices. As detailed above, the magnetic field generator 100 enables the operation unit 90, the magnetic field strength measuring devices, and the signal processing device to be operated in the predetermined safe distance away from the induction winding 50. Thus, the operators of the electromagnetic immunity measurements are protected from the magnetic field generated by the induction winding 50 during the electromagnetic immunity measurements. Furthermore, polarities of the magnetic field generated by the magnetic field generator 100 relative to measured electronic devices can be easily adjusted by changing the positions of inserting the measured electronic devices in the induction member 52.

It is to be further understood that even though numerous characteristics and advantages of the present embodiments have been set forth in the foregoing description, together with details of structures and functions of various embodiments, the disclosure is illustrative only, and changes may be made in detail, especially in matters of shape, size, and arrangement of parts within the principles of the present invention to the full extent indicated by the broad general meaning of the terms in which the appended claims are expressed.

What is claimed is:

1. A magnetic field generator, comprising:

a holding unit;

an induction winding slidably and rotatably mounted on the holding unit; and an operation unit electrically connected to the induction winding, and positioned in a predetermined distance away from the induction winding; the operation unit providing current to the induction winding, and the induction winding generating magnetic field in response to receiving the current from the operation unit;

wherein the holding unit includes an adjusting pole and a support block, the support block defines a first through hole and a second through hole, an axis of the first through hole being perpendicular to an axis of the second through hole; the induction winding is inserted into the second through hole to be rotatably mounted on the support block, and the adjusting pole is inserted into the first through hole to be slidably and rotatably mounted on the support block for adjusting an altitude of the induction winding relative to the adjusting pole.

2. The magnetic field generator as claimed in claim 1, wherein the induction winding includes an induction member and an insertion member, the induction member is an annular winding, and the insertion member is a cylinder made of insulation material; two ends of the induction winding both inserted in the insertion member and electrically connected to the operation unit, and the insertion member rotatably received in the second through hole to rotatably mount the induction winding on the support block.

3. The magnetic field generator as claimed in claim 2, wherein the support block further defines a first aperture, a second aperture, a first fastening hole, and a fourth fastening hole; all of the first aperture, the second aperture, the first fastening hole, and the fourth fastening hole opening on a surface of the support block; the first aperture communicating with the first through hole, and the second aperture communicating with the second through hole; both the first and second fastening holes being screw holes; the first fastening hole communicating with the first aperture, and an axis of the first fastening hole being perpendicular to the axis of the first through hole; the second fastening hole communicating with the second aperture, and an axis of the second fastening hole being perpendicular to the axis of the second through hole.

4. The magnetic field generator as claimed in claim 3, wherein the support block further includes two fasteners; both the two fasteners being screw bolts, and the two fasteners respectively screwed in the first and second fastening holes and extended into the first and second apertures; rotations of the two fasteners respectively making the adjusting pole and the insertion member to be released and fastened.

5. The magnetic field generator as claimed in claim 2, wherein the induction winding further includes a support pole and a retainer, the support pole being a telescopic pole coaxially received in the insertion member, and the retainer is mounted on a distal end of the support pole.

6. The magnetic field generator as claimed in claim 5, wherein the support block further includes a plurality of retaining protrusions configured for mounting magnetic field strength measuring devices on the support block, and the retainer is configured for mounting probes of the magnetic field strength measuring devices.

7. The magnetic field generator as claimed in claim 1, wherein the holding unit further includes a base and a holder mounted under the base, the adjusting pole mounted on the base, and the holder including support feet that enables the magnetic field generator to be stably positioned and conveying wheels that enables the magnetic field generator to be horizontally moved due to rotations of the conveying wheels.

* * * * *